United States Patent [19]

MacOnochie

[11] Patent Number: 4,838,363

[45] Date of Patent: Jun. 13, 1989

[54] ROCK-BREAKING APPARATUS

[75] Inventor: Ewen R. A. MacOnochie, Dunkeld, Australia

[73] Assignee: Quarry Engineering Developments Pty. Ltd., South Melbourne, Australia

[21] Appl. No.: 47,482

[22] Filed: May 11, 1987

[51] Int. Cl.[4] ..... B25D 17/24

[52] U.S. Cl. ..... 173/139; 173/89

[58] Field of Search ..... 173/139, 2, 89, 87

[56] References Cited

U.S. PATENT DOCUMENTS

| | | | |
|---|---|---|---|
| 3,566,978 | 3/1971 | Udert | 173/139 |
| 3,817,091 | 6/1974 | Frederick | 173/139 |
| 3,889,765 | 6/1975 | Henson | 173/87 X |
| 4,103,747 | 8/1978 | Finney | 173/139 |
| 4,562,974 | 1/1986 | Bezette et al. | 173/139 |

*Primary Examiner*—Frank T. Yost

*Assistant Examiner*—James L. Wolfe

*Attorney, Agent, or Firm*—Dennison, Meserole, Pollack & Scheiner

[57] ABSTRACT

Rock breaking apparatus includes a guide column within which a weight falls under gravity to strike a tool. A piece of shock-absorbing material is located at or near the base of said column such that it enables force to be transmitted from said weight to the tool, while minimizing the effect of the impact of said weight on other parts of the apparatus. The piece of shock-absorbing material has an aperture therethrough, for the passage of the tool. The tool may have a recessed portion which co-operates with a retaining pin located substantially at right angles to the direction of motion of the tool. The apparatus may also have an operating device, including a device for raising a weight, a device for holding a weight in one of a number of positions and a device for allowing said weight to fall.

10 Claims, 7 Drawing Sheets

ROCK-BREAKING APPARATUS

BACKGROUND OF THE INVENTION

1. Field of the Invention

This invention relates to improvements in rock-breaking apparatus of the general type described in Australian patent specification no. AU-B-27994/77 (522890).

2. Description of the Prior Art

Rock breaking apparatus of the type described in AU-B-27994/77 includes a rock-breaking tool, a tool housing having a bore therethrough, in which the tool body is mounted for limited movement axial to the bore, a weight designed to fall under the influence of gravity to impart an impulse to said tool, and means to raise the weight.

Very large forces are generated in the use of said apparatus. They are often sufficient to destroy the upper collar on the tool body as it is driven against the upper edge of the bore, which collar serves to limit downward movement of the tool. This means that the tool must be replaced, which is an expensive and time-consuming operation. In the specification of Australian patent specification no. AU-B-90861/82 (536689), corresponding to U.S. Pat. No. 4,562,974 there is suggested a complex arrangement for cushioning the effect on the apparatus as a whole of the force applied to the tool, by providing a resiliently-mounted telescopic member at the lower end of a guide column, through which the weight falls. However, the specification does not address the problem of the effect of the force on the tool per se.

BRIEF SUMMARY OF THE INVENTION

It is an object of this invention to provide an effective improved rock breaking apparatus, which will overcome at least some of the disadvantages of the prior art.

The invention provides apparatus for breaking rocks or the like, in which a guide column within which a weight falls under gravity to strike a tool or other article, characterized in that shock-absorbing material is located at or near the base of said column such that it enables force to be transmitted from said weight to a tool, whilst minimising the effect of the impact of said weight on other parts of said apparatus.

The invention also provides apparatus for breaking rocks, in which a weight is allowed to fall, under the influence of gravity, in a guide column, to strike a tool or other article, said tool being mounted for limited movement in an aperture in the base of said column, characterized in that said tool has a recessed portion which co-operates with a retaining pin located substantially at right angles to the axis of said aperture.

The invention further provides apparatus for breaking rocks, in which a weight may fall under the influence of gravity to strike a tool or other article, characterized by operating means for operating said apparatus, including means for raising a weight, means for holding a weight in one of a number of positions and means for allowing said weight to fall.

The invention also provides apparatus for breaking rocks in which a weight may fall under the influence of gravity in a guide column to strike a tool, characterized by tool and/or weight sensing means located on or near said column.

DETAILED DESCRIPTION OF THE PREFERRED EMBODIMENT (S)

Figure 1:
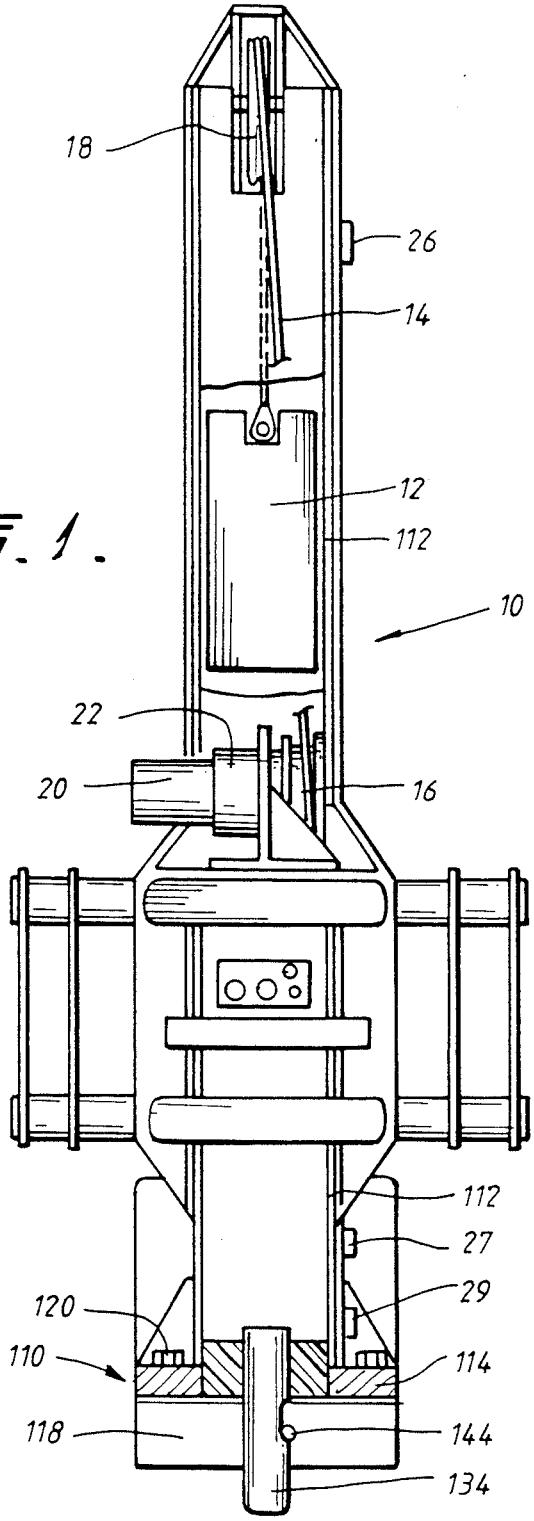
FIG. 1 is a front elevation of rock-breaking apparatus according to the invention.

The rock breaking apparatus is of the general type illustrated in FIG. 1 of Australian patent specification no. AU-B-27994/77 (522890).

The apparatus 10 of FIG. 1 includes a lower end 110, an embodiment of which will be described in detail hereinafter, a guide column 112, a weight 12 located for movement within. said column, and a cable 14 or the like connecting weight 12 with a drum 16 around a pulley 18.

The apparatus also includes hydraulic components such as a valve bank system, to be described in detail hereinafter, a high torque motor 20, an hydraulic clutch 22 (which may be a centrifugal clutch, but this is not preferred) and a high torque gearbox 24 incorporated into drum 16.

Proximity switches 26, 27 and 29 are located on guide column 112 to detect positions of weight 12 and pin 144 (described hereinafter). The operation of the switches will be described in relation to FIG. 8.

The housing 110 of this embodiment is located at the lower end of guide column 112, which is shown (FIG. 2) having a generally square cross-section. The weight (not shown in this figure) has a corresponding square cross-section, although of course one with a circular cross-section could also be used.

Welded to the lower end of column 112 is an annular plate 114, which is also connected to the column 112 by rib plates 116.

Lower plate 118 is secured to annular plate 114 by bolts 120, each of which passes through an aperture in plate 114, and is screwed into a corresponding threaded aperture in the hardened steel of plate 118. A hardened wear washer 128 is provided adjacent plate 114. A resilient gasket or the like 130 may be provided between plates 114 and 118, to act as a cut-off point for shock waves being transmitted from one metal surface to another. The gasket 130 may alternatively be omitted.

Plate 118 has an axial cylindrical bore 132 therethrough, co-axial with guide column 112. A generally cylindrical hardened steel tool 134 is mounted, for axial movement, in bore 132. The tool 134 has curved edges 136 at its working end 138, such that the tool is quite blunt. Tool 134 also has a recess 140 in one side thereof.

An off-centre transverse bore 142 is also provided in plate 118. It is designed to accommodate a pin 144, which in use co-operates with recess 140 to limit the axial movement of tool 134 in bore 132.

The pin 144 is designed, as stated, to limit the axial movement of tool 134 in bore 132, but also serves to enable the tool 132 to be removed therefrom, without having a split-plate arrangement such as that of the prior art. Many alternative forms of location and securement of pin 144 in the aperture 142 may be utilised; the pin may be slightly tapered to allow it to be hammered into place, but to also allow it to be easily removed upon the application of a reverse impulse. A circlip may be used to secure this pin also.

It may be considered to have two pins and associated recesses, one on either side (as viewed in FIG. 3) of tool 134. This would provide a balancing effect, although one would have to be satisfied that the double reduction in thickness of the tool body would not reduce the strength thereof.

Located within guide column 112 is an annulus 146 of polyurethane, or any other suitable material, such as a relatively dense plastics or elastomeric material capable of deformation, but with a 'memory' which allows it to return to its original shape after deformation.

In use, the lower end 110 operates as follows.

To break a rock, lower end would normally be positioned with the working end 138 of tool 134 in contact with the rock. The tool would then be in the position shown in FIG. 3.

The weight (not shown) would then be allowed to fall under the influence of gravity, to strike the top of the tool 134, to propel it downwards to break the rock. It can be seen that the top of tool 134 protrudes above annulus 146, so that initially the force of the weight is taken fully by the tool 134. When the weight reaches the top of annulus 146, the annulus also absorbs some of the force, and serves as a cushioning member, allowing itself to be deformed such that (as viewed in FIG. 2) the material of the annulus can move into the corners 148 of the guide column 112, which corners are normally unoccupied by material. The further the weight travels into the annulus 134, the more is the deceleration effect, and eventually the weight will stop, before it strikes plate 118, and before it forces the upper shoulder of recess 140 into heavy contact with pin 144. When the weight is raised, the annulus will return to its original shape, ready for the next impact.

Figure 4:
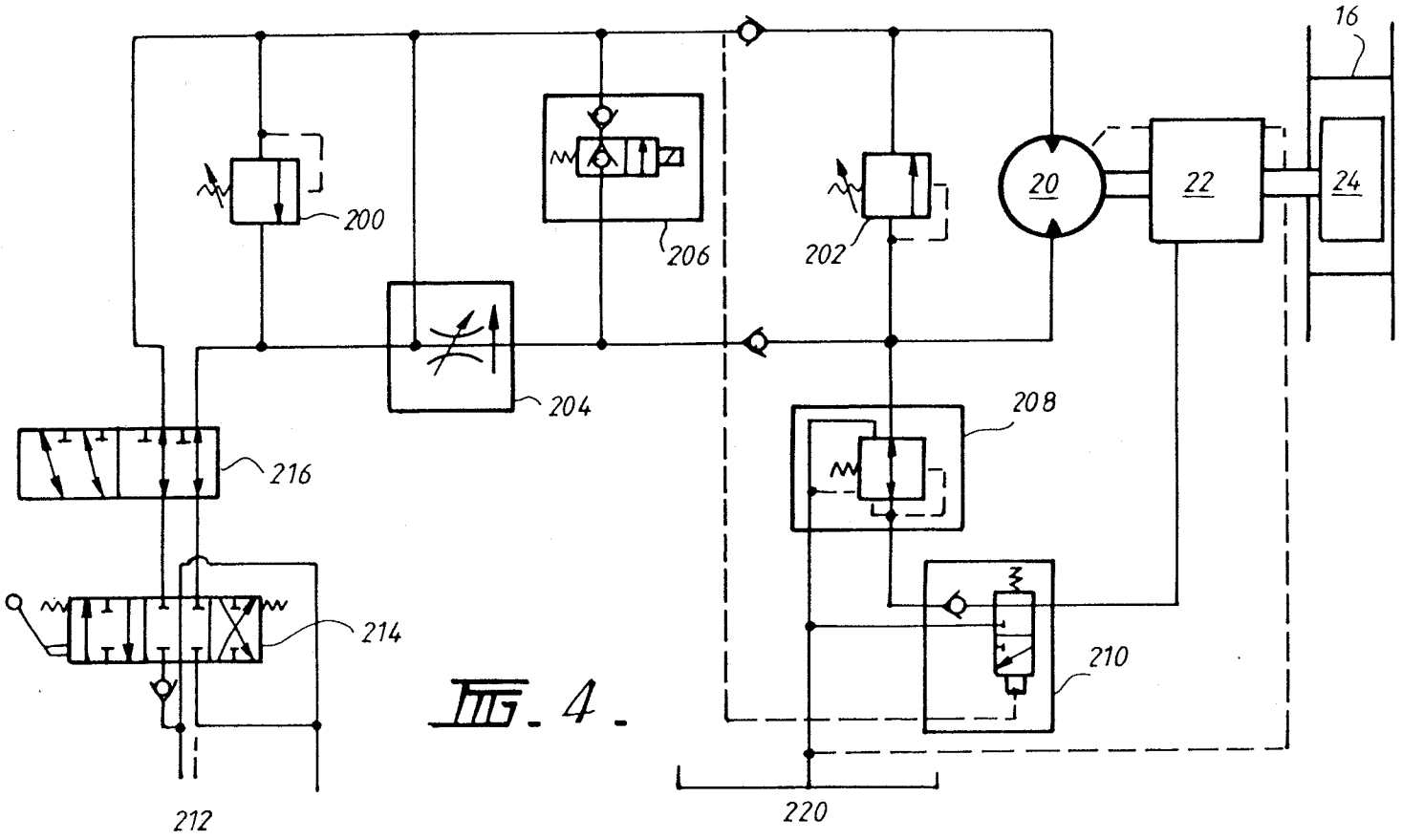
FIG. 4 is a circuit diagram of the hydraulic system used in the apparatus of FIG. 1.

FIG. 4 is a circuit diagram of an hydraulic system which may be used to operate the apparatus of FIG. 1. The following components shown in FIG. 1 also appear in FIG. 4; hydraulic motor 20, hydraulic clutch 24 and drum 16. Gearbox 24 (mentioned in relation to FIG. 1) is also shown.

The system includes relief or check valves 200,202 which act to protect major components. Flow-control valve 204 permits a flow of approximately 220 litres per minute of fluid during the 'raise' mode (to be described hereinafter) and acts to divert excess flow back to the carrier/hydraulic pump 212.

A two-way solenoid valve 206 allows all the flow (fluid) to pass back to the carrier when signalled to do so by proximity switch 26 (FIG. 1). This prevents the tool 134 (FIGS. 2 and 3) striking the inside top of guide column 112 (FIG. 1) in the absence of an operator releasing the apparatus from the 'raise' mode.

A pressure-reducing valve 208 allows the required pressure to pass, allowing the activation valve 210 to activate. The activation valve 210 activates hydraulic clutch 22 with a pressure of approximately 420 p.s.i. (30 BAR) to allow clutch 22 to engage. Valve 210 also allows the clutch 22 to disengage when the 'release' mode is selected by an operator or the like.

Preferably, valves 200 to 210 inclusive are incorporated in a valve bank; that is, the valves are located in proximity to one another in a single housing, and the hydraulic conduits are plumbed to the valves in the valve bank. Such an arrangement is more efficient for maintenance. However, the valves may be located in other appropriate ways.

The hydraulic motor 20 is a high speed, high torque motor necessary for high performance of a fast cycle, such as the 'raise' mode of the apparatus 10.

The hydraulic clutch 22 is designed to engage hydraulically and disengage under spring pressure. When engaging ('raise' mode) the hydraulic pressure couples the clutch input shaft (not shown) to the clutch output shaft (not shown) to allow torque to be transmitted through the clutch 22 to the gearbox 24. When the 'release' mode is selected the activation valve 210 allows the hydraulic pressures to fall to zero, thus allowing the clutch 22 to spring-disengage to allow the winch drum 16 to freely rotate. A minor modification could be made for a clutch with an 'hydraulic disengage, spring engage' mode of operation.

The function of the gearbox 24 is to reduce the revolutions from the hydraulic motor to approximately 50 r.p.m.. The gearbox 24, being mounted strategically within drum 16, allows maximum torque to be transmitted.

For operational reasons, it may be considered preferable to locate the clutch 22 at the outside of the clutch-motor-gearbox arrangement, so that one would have, from the left in FIG. 1, clutch 22, motor 20, gearbox 24.

The system also has carrier 'tilt' or spool valves 214, and an optional six-port cross-over diversion valve 216. Drain line 220 leads to carrier 212.

Figure 5:
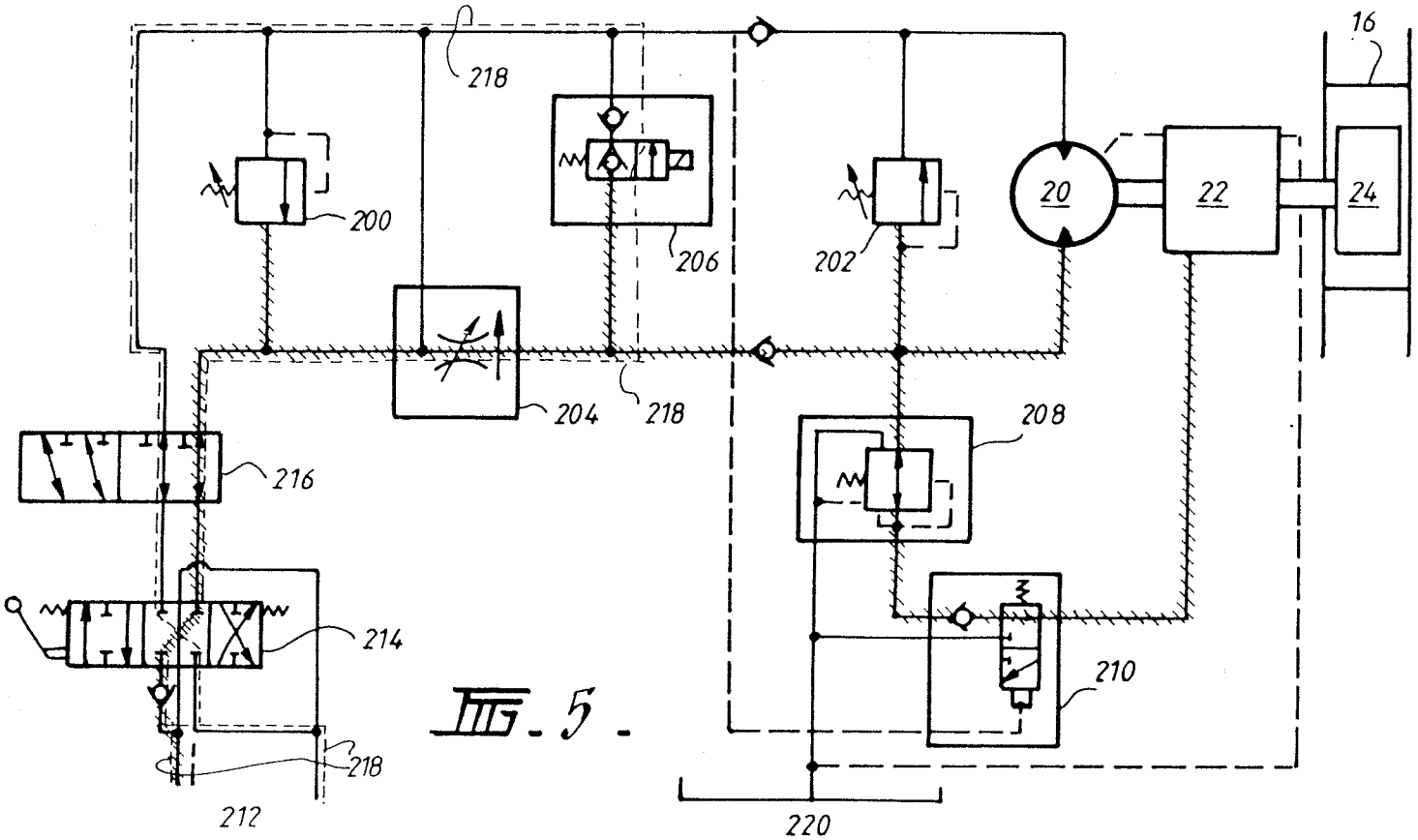
FIGS. 5 to 7 are diagrams similar to that of FIG. 4, showing different phases of the operation of the system.

Reference is now made to FIG. 5, which shows the system with the 'raise' mode selected; the 'raise' mode is used to bring hammer 12 to its maximum height in guide column 112 (FIG. 1). The lines subject to hydraulic pressure are hatched, and those subject to pressure once proximity switch 26 (FIG. 1) has been actuated are shown as broken line 218.

With the 'raise' mode selected, the carrier/hydraulic pump 212 supplies fluid under pressure, which is allowed into the circuit by valve 214. Optional valve 216 may act to divert some fluid.

Flow-control valve 208 allows the required volume of fluid therethrough, and the hydraulic motor 20 is activated. The pressure-reducing valve 208 and the clutch activation valve 210 operate to engage the clutch 24, which in turn activates the drum 16. Drum 16 winds rope 14, raising weight 12.

Normally, one would expect an operator to shut off the 'raise' mode controls when the weight 14 reaches a useful but safe height. However, if that is not done, the line 218 pressurization takes place, in that the position of hammer 14 activates proximity switch 26, which in turn operates solenoid valve 206. The solenoid valve 206 opens, preventing supply of fluid to motor 20, thus preventing further raising of weight 14.

Figure 6:
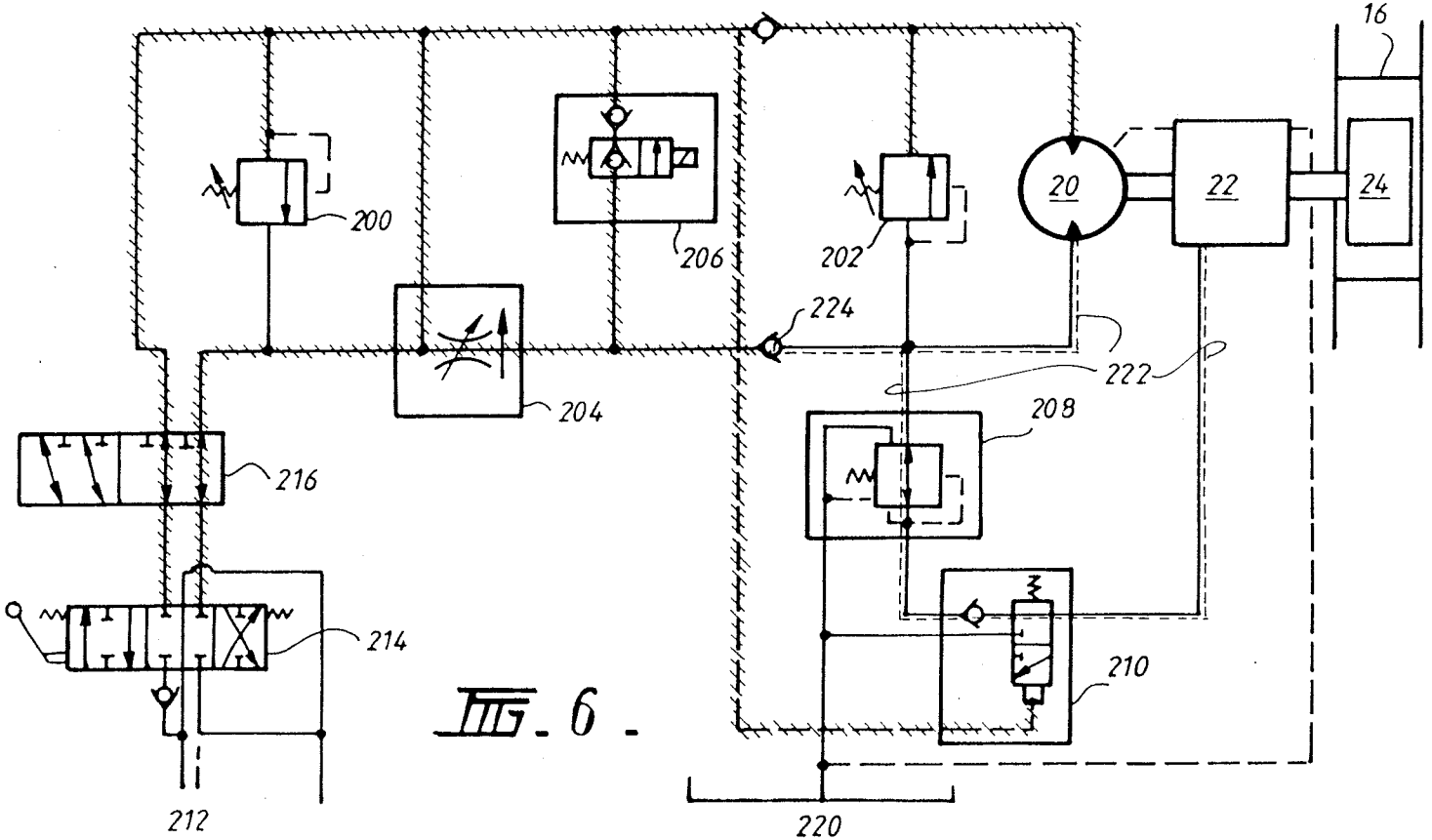

FIG. 6 shows the circuit of hydraulic system in the 'hold' mode. Lines subject to tank pressure are shown hatched, and lines subject to load pressure are denoted by broken lines 222.

As can be seen, tank pressure fluid is locked between components 200, 202, 210, 214 and 224. When the controls for the 'hold' mode are selected, the weight/hammer 14 can be held at any point.

Figure 7:
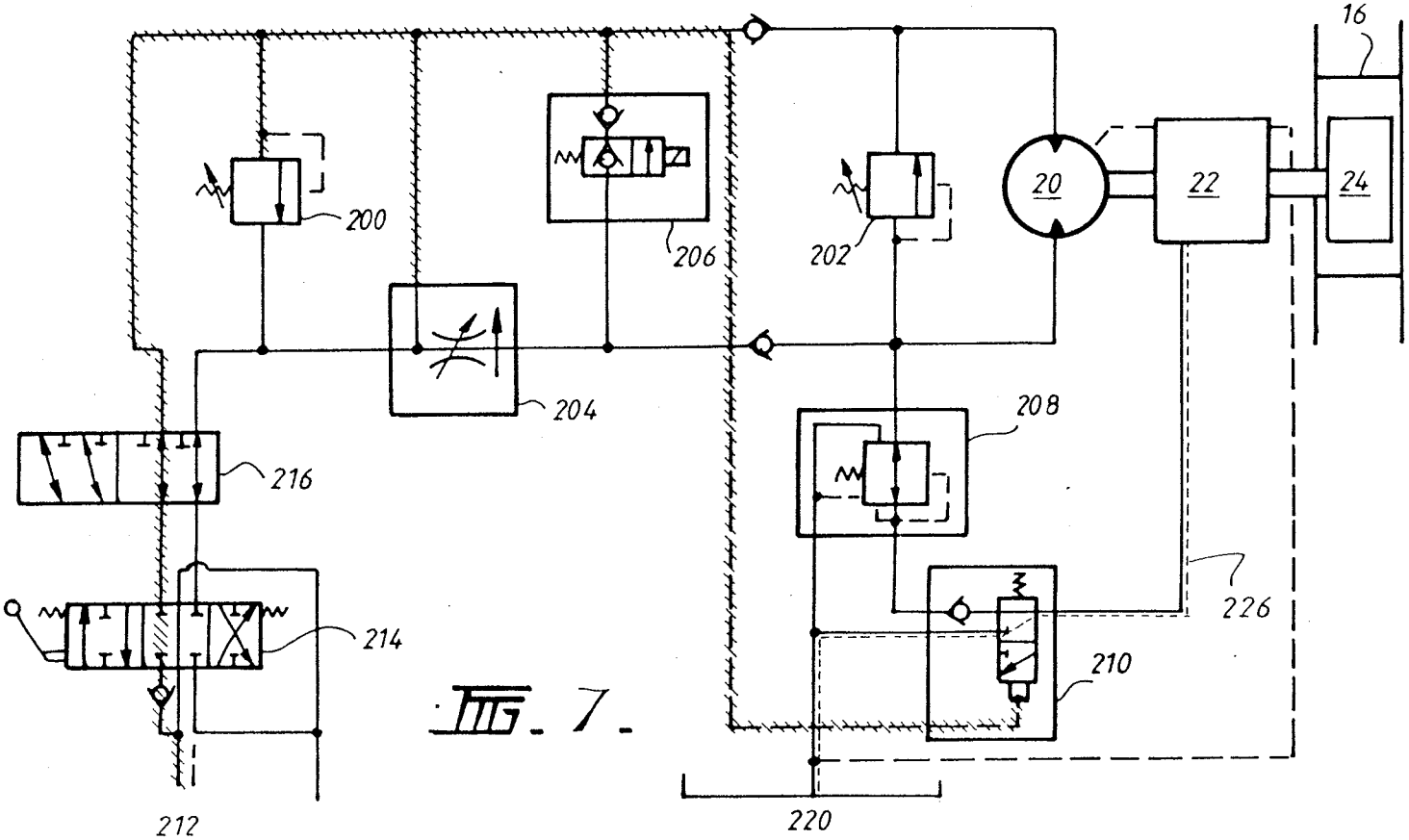

Finally, FIG. 7 shows the state of the system when the 'release' mode is selected. Lines subject to pump pressure are shown hatched. Broken line 226 denoted the drain line to tank 220 at tank pressure, which is minimal.

Figure 2:
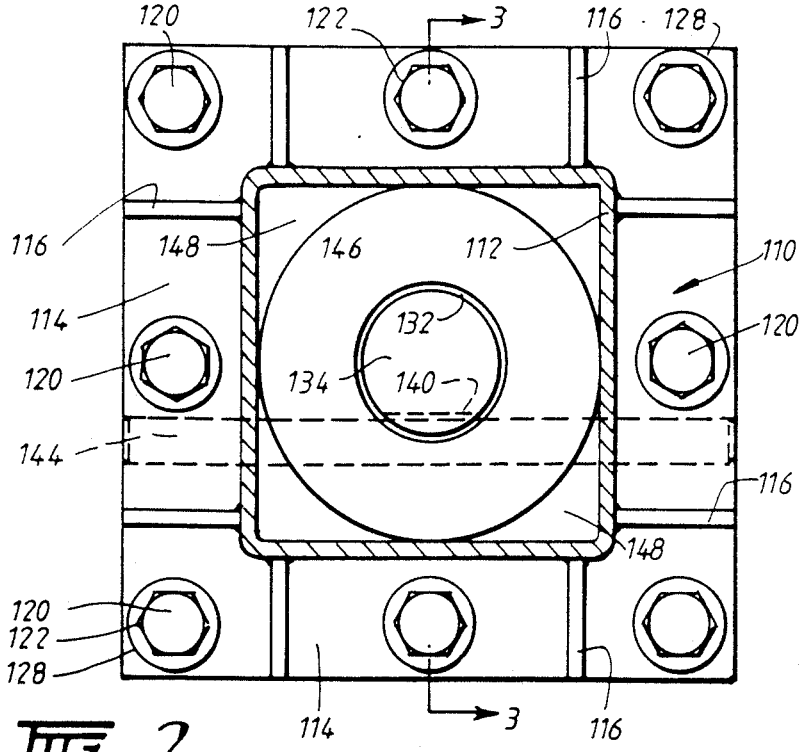
FIG. 2 is a plan view of the lower end of the apparatus of FIG. 1.
Figure 3:
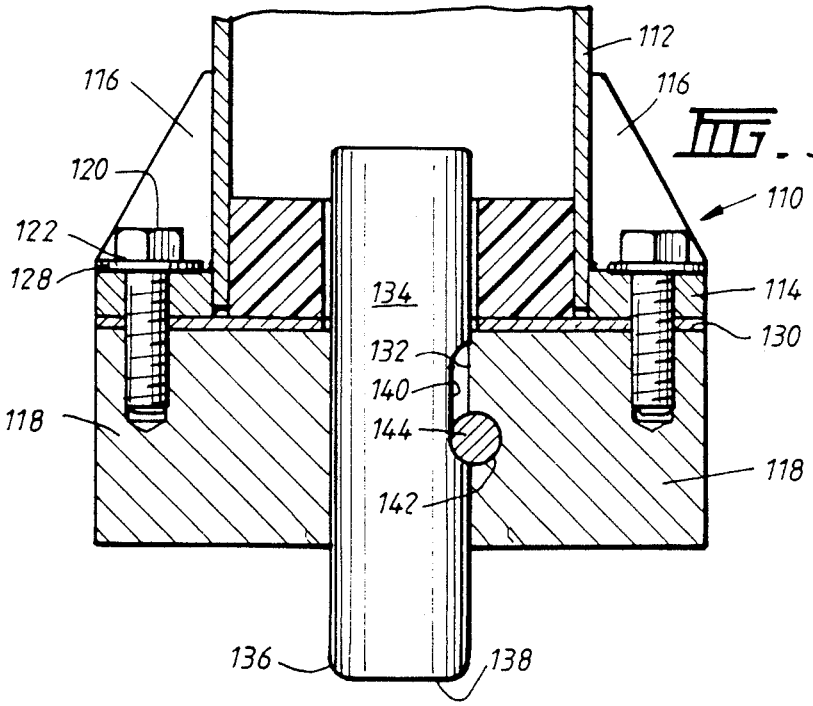
FIG. 3 is a vertical cross-section along the lines 3—3 of FIG. 2.

Fluid is supplied by carrier 212 through valves 214 at (optionally) 26. The pressure relief valve 208 allows a required pressure, and clutch activation valve 210 operates to disengage the clutch 22. The gearbox 24 and drum 16 are then free to rotate, which they do as weight 12 falls under the influence of gravity to strike tool 134 (FIGS. 2 and 3). If, for some reason, the 'raise' mode is selected during the free fall of weight 12, the pressure relief valve 202 which operate to allow deceleration to occur, thus preventing damage to the motor 20 and its components.

In use, the apparatus 10 (which is preferably mounted on a vehicle or the like for easy transportation) is located over an area of rock or the like to be broken, preferably with the working surface 138 of tool 134 placed on the rock or the like.

The operator then selects the 'raise' mode, which operates as described hereinbefore to raise hammer 12. Once the weight 12 has reached a desirable height (which may be indicated by some form of visual or other indication) the operator may select the 'hold' mode, and may then proceed to select the 'release' mode, or may go straight to the 'release' mode. In the 'release' mode the hammer 12 falls to strike tool 134, driving it with an impulse into the rock or the like.

Figure 8:
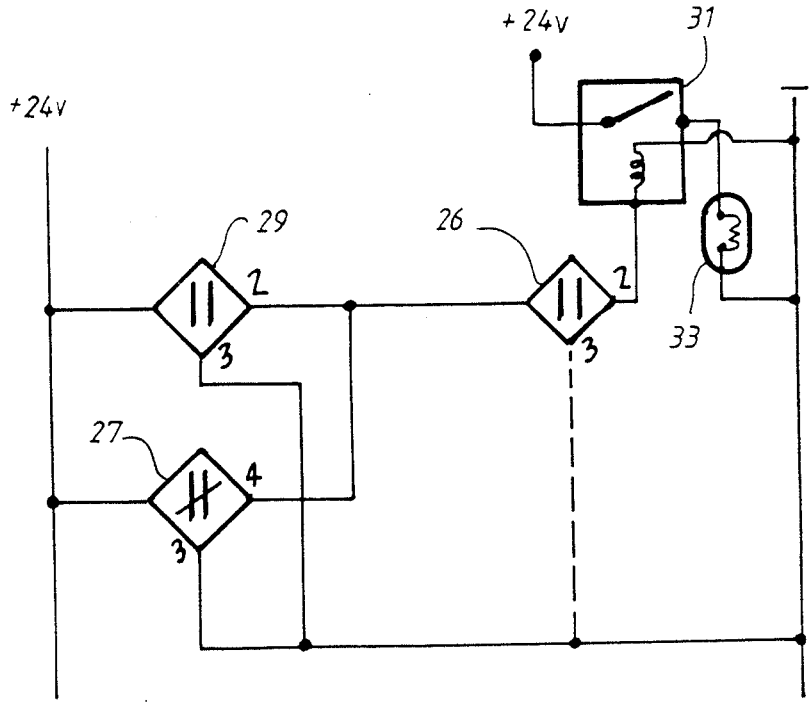
FIG. 8 is an electrical circuit diagram concerning the operation of proximity switches.

FIG. 8 is an electrical circuit diagram into which the three proximity switches 26, 27 and 29 are wired. The switches sense the presence or absence of the weight 12 or the pin 144, and function, through relay 31 and solenoid 33, to engage or disengage the hydraulics which raise weight 12.

The proximity switches are arranged so that switches 26, 29 are normally closed, in series, and switch 27 is normally open in parallel. The switches activate when magnetic contact is made with weight 12 or pin 144.

Switch 26 goes to a closed mode when the weight 12 is sensed, near the top of guide column 112, and this serves to stop the raising of the weight 12. All is in readiness for the release of the weight.

However, if at this stage pin 144 is not sensed by switch 29, that is, if it is not in the position shown in FIG. 1, but is in a lower (incorrect) position, the weight will not be released because switch 29 will be open. Only when the apparatus is correctly positioned will the top of pin 144 be sensed by switch 29.

If pin 144 is sensed, the circuit will operate the hydraulics to raise the weight 12. When weight 12 passes switch 27 a first time, going up, it will be sensed, but will not affect the continued raising of the weight. Only when the weight 12 is sensed by switch 27 on the way down, will the circuit operate to brake drum 16, preventing overrun of the cable 14 (and 'whiplash') and minimising the impact on the base 110 of the apparatus 10.

It can be seen that this invention provides apparatus for breaking rocks and the like, which is effective and safe in its operation. It is clear that the essence of the invention could be used in apparatus for other purposes, such as pile driving.

What I claim is:

1. In an apparatus for breaking rocks, said apparatus including a guide column, said guide column having a base end and a peripheral wall inward of said base end, a tool at said base, said tool being adapted for limited movement in the direction of the axis of said guide column, a weight movable within said guide column and adapted to fall under the influence of gravity to strike the tool at said base end, the improvement comprising shock-absorbing material provided at said base end, said shock-absorbing material being located within said peripheral wall in the path of fall of the weight and including an upper impact surface for impact of the falling weight, said peripheral wall defining a cross-sectional area, said material occupying a cross-sectional area less than that defined by said wall, said material being adapted to absorb direct impact of said weight thereon, at least partly by deforming into the greater cross-sectional area of said peripheral wall to minimize the effect of the impact of said weight generally on said apparatus while enabling force to be transferred from said weight to said tool, said shock-absorbing material including an aperture adapted to allow a portion of said tool to pass therethrough, said tool in a first position, at which it is at the upper limit of its limited movement, having part thereof extending above said upper surface, being adapted to be first impacted by said weight, said weight subsequently impacting said upper surface when said part of said tool is moved below said upper surface as a result of the impact of said weight or said tool.

2. Apparatus according to claim 1, wherein said material is annulus-shaped, with a central aperture receiving said tool therethrough.

3. Apparatus according to claim 2, wherein th e cross-sectional area of the peripheral wall is substantially square.

4. Apparatus according to claim 2 wherein said shock-absorbing material is an impact deformable elastomeric material with memory.

5. Apparatus according to claim 1 including an aperture defined through said base end, said tool being mounted for limited movement in said aperture for extension beyond said base end upon being struck by said weight, said tool having an elongate recessed portion, and a retaining pin mounted on said base end and received within the recessed portion transversely thereacross.

6. Apparatus according to claim 1, including operating means for operating said apparatus, said operating means comprising means for raising the weight, means for holding the weight in one of a number of positions and means for allowing said weight to fall.

7. Apparatus according to claim 6, wherein said operating means includes a hydraulic system.

8. Apparatus according to claim 6, wherein said operating means includes a drum on which a cable attached to said weight may be wound and unwound, clutch means and gearbox means.

9. Apparatus according to claim 1, including means for sensing the tool and the weight located proximate said column.

10. Apparatus according to claim 9, wherein said sensing means is part of a control circuit which controls the operation of said operating means.

* * * * *